US006843346B2

(12) United States Patent
LeBeau et al.

(10) Patent No.: US 6,843,346 B2
(45) Date of Patent: Jan. 18, 2005

(54) BELAY DEVICE FOR CLIMBERS

(75) Inventors: Mark LeBeau, Logan, UT (US); Seth Murray, Boulder, CO (US); Malcolm Daly, Boulder, CO (US)

(73) Assignee: Great Trangs Holdings, Inc., Boulder, CO (US)

( * ) Notice: Subject to any disclaimer, the term of this patent is extended or adjusted under 35 U.S.C. 154(b) by 0 days.

(21) Appl. No.: 10/418,029

(22) Filed: Apr. 17, 2003

(65) Prior Publication Data

US 2003/0196853 A1 Oct. 23, 2003

Related U.S. Application Data

(60) Provisional application No. 60/373,777, filed on Apr. 18, 2002.

(51) Int. Cl.[7] ..... A47L 3/04; A62B 1/20; B65H 59/14

(52) U.S. Cl. ..... 182/5; 182/192; 188/65.4

(58) Field of Search ..... 182/5, 6, 7, 191, 182/192, 193; 188/65.1, 65.2, 65.4, 65.5

(56) References Cited

U.S. PATENT DOCUMENTS

| | | | | |
|---|---|---|---|---|
| 621,475 A | | 3/1899 | McCormick | |
| 1,727,687 A | | 9/1929 | Agobian | |
| 4,596,314 A | | 6/1986 | Rogelja | |
| 4,643,377 A | | 2/1987 | Christianson | |
| 4,912,817 A | | 4/1990 | Sandreid | |
| 5,076,400 A | * | 12/1991 | Petzl et al. | 188/65.5 |
| 5,360,083 A | * | 11/1994 | Hede | 182/5 |
| 5,577,576 A | * | 11/1996 | Petzl et al. | 188/65.4 |
| 5,597,052 A | * | 1/1997 | Rogleja | 188/65.5 |
| 5,934,408 A | * | 8/1999 | Flux | 182/5 |
| 5,954,153 A | * | 9/1999 | Rogelja | 182/5 |
| 5,975,243 A | * | 11/1999 | Lorbek | 182/193 |
| 6,029,777 A | * | 2/2000 | Rogelja | 182/193 |
| 6,155,384 A | * | 12/2000 | Paglioli | 188/65.2 |
| 6,378,650 B2 | * | 4/2002 | Mauthner | 182/5 |
| 6,467,574 B2 | * | 10/2002 | Lara | 182/36 |
| 6,561,313 B2 | * | 5/2003 | Hewlett et al. | 182/5 |
| 6,681,891 B2 | * | 1/2004 | Richard et al. | 182/5 |

FOREIGN PATENT DOCUMENTS

| | | |
|---|---|---|
| EP | 0 012 126 | 11/1979 |
| EP | 0 132 592 | 6/1984 |
| FR | 2 371 375 | 5/1976 |
| FR | 2 451 752 | 3/1979 |
| FR | 2 478 475 | 3/1980 |
| GB | 2 131 921 | 6/1984 |

* cited by examiner

*Primary Examiner*—Hugh B. Thompson, II
(74) *Attorney, Agent, or Firm*—Emery L. Tracy

(57) ABSTRACT

A belay device for climbing with at least one rope is provided. The belay device comprises a first plate having a first lobe with the rope wrapping at least partially about the first lobe and a second plate having a second lobe. A connection mechanism connects the first plate to the second plate through a rotation point with the rotation point positioned inside the second lobe. A first channel is defined by the first plate and the first lobe and the second plate and the second lobe with the rope moveable through the first channel wherein tension on the rope rotates the first plate and the second plate relative to each other thereby narrowing the first channel and impeding movement of the rope through the first channel.

20 Claims, 7 Drawing Sheets

BELAY DEVICE FOR CLIMBERS

BELAY DEVICE FOR CLIMBERS

The present application is a continuation-in-part and claims priority of pending provisional patent application Ser. No. 60/373,777, filed Apr. 18, 2002, entitled "Belay Device for Climbers".

BACKGROUND OF THE INVENTION

1. Field of the Invention

The present invention relates to the fields of mountain and rock climbing and, more particularly, it relates to a belay device for controlling the ascent or descent of a climber.

2. Description of the Prior Art

Rock climbing involves the challenge of navigating a rock face which is often essentially vertical. Rock climbing and rappelling have recently become more popular, as have other so-called "extreme" sports. Rock climbing offers individuals an opportunity to be outdoors and participate in an activity that is both rewarding and challenging, while at the same time being non-destructive to the natural environment.

At the start of the climb, the climber will determine the path to be taken as the climber ascends the rock face. The climber will generally need to use his or her entire body as that ascent takes place. Beyond the climber's body, a number of pieces of equipment are generally used by the rock climber. This equipment varies from climbing shoes equipped with tough rubber soles, to sewn harnesses, to special climbing rope.

The sport of climbing or mountaineering typically requires a team of two people. To ensure the safety of the climber, the climber ties into a rope (i.e. the rope is tied to a harness worn by the climber), and is belayed by a partner. While the climber ascends, the belayer takes up or lets out the rope such that the rope is maintained taut between the climber and belayer, preventing a fall of any great distance by the climber. One type of belaying system, known as "top-roping", employs an anchor placed at the top of the cliff. Typically, the rope runs through this anchor pulley-fashion and the belayer stands at the foot of the cliff, although in some cases the belayer will belay from the top. In either case, the anchor is above the climber at all times, so that the climber will fall only a short distance if he "falls off" the climb.

Due to the dangers involved in climbing, a need exists for belay devices which are reliable and durable for supporting a climber in an emergency situation. The present invention fulfills these needs as described and claimed below.

SUMMARY

The present invention is a belay device for climbing with at least one rope. The belay device comprises a first plate having a first lobe with the rope wrapping at least partially about the first lobe and a second plate having a second lobe. A connection mechanism connects the first plate to the second plate through a rotation point with the rotation point positioned inside the second lobe. A first channel is defined by the first plate and the first lobe and the second plate and the second lobe with the rope moveable through the first channel wherein tension on the rope rotates the first plate and the second plate relative to each other thereby narrowing the first channel and impeding movement of the rope through the first channel.

In addition, the present invention is a system for controlling the ascent and descent of a climber. The system comprises at least one rope, at least one carabiner, and a first plate. A second plate is rotatably secured to the first plate about a rotation point and has an aperture for receiving the carabiner. Inhibiting means on the first plate and the second plate define a channel wherein upon tension of the rope, the aperture and the rotation point are offset and the aperture is aligned in the direction of the rope tension.

The present invention further includes a method for inhibiting a climber from falling during climbing. The method comprises providing at least one rope, providing at least one carabiner, providing a belay device having a first plate rotatably secured to a second plate, forming a first lobe on the first plate and a second lobe on the second plate, inserting a portion of the rope into the belay device about at least a portion of the first lobe with the rope slidable about the first lobe, attaching the carabiner to the belay device, applying a force to the rope in a direction generally away from the carabiner, rotating the first plate relative to the second plate, inhibiting movement of the rope through the belay device between the first lobe and the second lobe, and rotating the first plate relative to the second plate in an opposite direction to separate the first lobe and the second lobe thereby allowing the rope to slide through the belay device.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENTS

As illustrated in FIGS. 1–10, the present invention is a belay device, indicated generally at 10, for use in climbing activities and the like. The belay device 10 of the present invention is moveable from a released first position to an impeded second position and can be used by climbers and others during any type of climbing activity including, but not limited to, mountaineering, rock climbing, safety descents during emergencies and rescues, etc. Other uses for the belay device 10 are also within the scope of the present invention.

Figure 1:
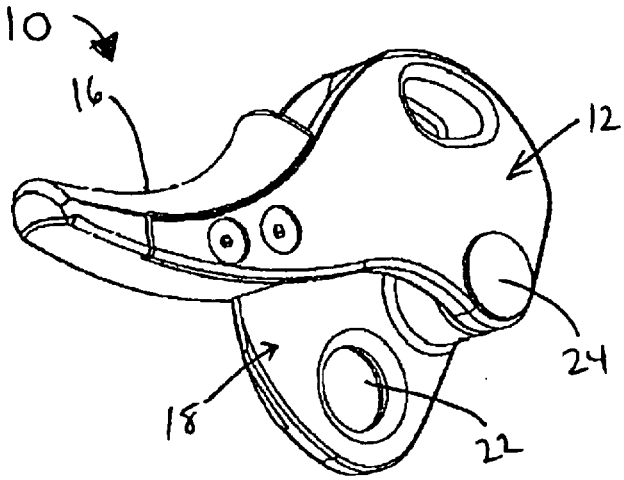
FIG. 1 is a perspective view illustrating a belay device for climbers, constructed in accordance with the present invention.
Figure 2:
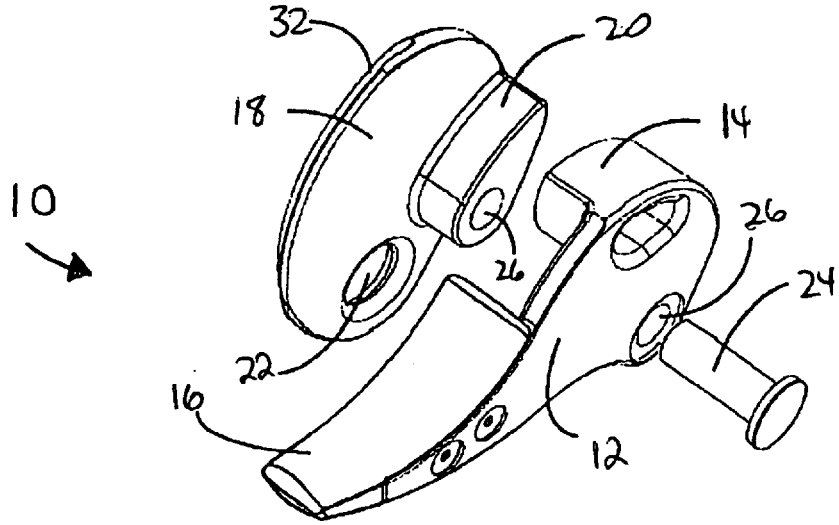
FIG. 2 is an exploded view illustrating the belay device for climbers of FIG. 1, constructed in accordance with the present invention.

As illustrated in FIGS. 1 and 2, the belay device 10 of the present invention includes a swivel plate 12 having a swivel lobe 14 and a handle 16 extending from the swivel plate. The handle 16 can be formed as part of the swivel plate 12 or can be fixedly attached to the swivel plate 12, depending on the desires of the manufacturer.

In addition, the belay device 10 of the present invention includes a base plate 18 pivotally connected to the swivel plate 12. Preferably, the base plate 18 also includes a base lobe 20 and a carabiner receiving hole 22 for receiving a carabiner (not shown). Preferably, both the swivel lobe 14 and the base lobe 20 are integrally formed with the swivel plate 12 and the base plate 18, respectively.

The belay device 10 of the present invention further includes a connecting pin 24 extending through the swivel plate 12 and the base plate 18 thereby allowing the swivel plate 12 to rotate relative to the base plate 18 and the base plate 18 to rotate relative to the swivel plate 12. The connecting pin 24 extends through aligned pin-receiving apertures 26 in the swivel plate 12 and the base lobe 20 of the base plate 18. The connecting pin 24 can be secured through the swivel plate 12 and the base plate 18 with a nut or other fastening means.

As mentioned above, at least one of the plates 12, 18 is rotatable about the connecting pin 24. In an embodiment of the belay device 10 of the present invention, the connecting pin 24 can be integrally formed with the swivel plate 12 and extend therefrom into the hole in the base lobe 20 of the base plate 18.

When the belay device 10 is assembled, the plates 12, 18 and the lobes 14, 20 define a channel 28 through which a rope 29 is fed. Because the swivel plate 12 and the base plate 18 can rotate with respect to each other about the connecting pin 24, the swivel lobe 14 and the base lobe 20 can be brought closer together to impede the movement of the rope 29 through the belay device 10, or separated to allow the rope 29 to move through the belay device 10 more freely.

Figure 3:
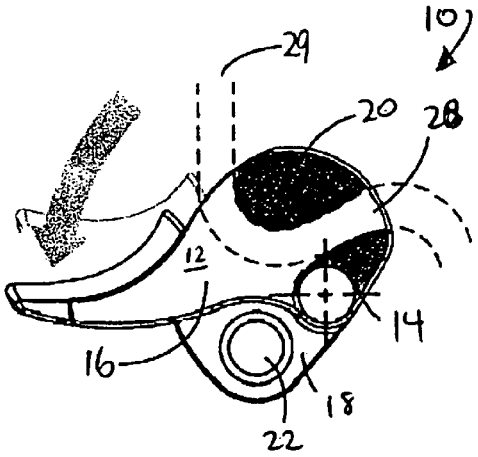
FIG. 3 is an elevational side view illustrating the belay device for climbers of FIG. 1, constructed in accordance with the present invention, with the belay device in an unlocked position with the rope being free to move through the belay device.

FIG. 3 illustrates the belay device 10 of the present invention while in use where the rope 29 is free to move through the belay device 10. As illustrated in FIG. 3, the swivel lobe 12 and the base lobe 20 are sufficiently separated, widening the channel 28, allowing the rope 29 to move freely through the belay device 10. Putting pressure on the handle 16, as illustrated in FIG. 3, increases the separation between the swivel lobe 14 and the base lobe 20.

Figure 4:
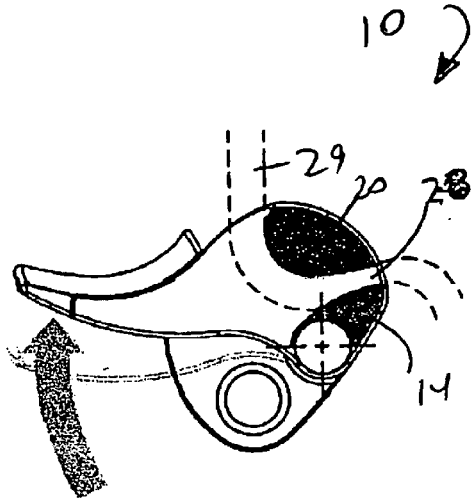
FIG. 4 is an elevational side view illustrating the belay device for climbers of FIG. 1, constructed in accordance with the present invention, with the belay device in a locked position with the rope being impeded in its movement through the belay device.
Figure 5:
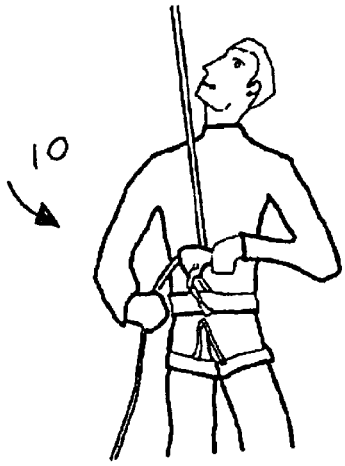
FIG. 5 is an elevational side view illustrating a climber using the belay device for climbers of the present invention to control the ascent or descent of another climber.

FIG. 4 illustrates the belay device 10 of the present invention while in use where the rope 29 is impeded in its movement through the belay device 10. As illustrated in FIG. 4, the swivel lobe 14 and the base lobe 20 are urged toward each other, narrowing the channel 28 through which the rope 29 moves thereby slowing or stopping movement of the rope 29 through the belay device 10.

It should be noted that the carabiner receiving hole 22 and the pivot point through the base lobe 20 are offset. In fact, when the rope is under tension, the carabiner receiving hole 22 is aligned in the direction of the rope tension thereby allowing movement of the swivel plate 12 and the base plate 18 relative to each other and causing narrowing of the channel 28.

When there is a pull on the rope 29 (e.g., the upper portion of the rope 29 shown in FIG. 4 is placed under tension), such as would occur if the climber attached to the rope 29 fell, the swivel plate 12 will naturally be pulled upward by the rope 29 (as indicated by the arrow in FIG. 4). This upward movement of the swivel plate 12 narrows the channel 28 and either slows or stops movement of the rope 29 through the belay device 10.

It should be noted that the swivel lobe 12 and the base lobe 20 can be of a wide variety of shapes to better grip the rope 29 when urged toward each other and are not limited by the shapes described and illustrated herein. In fact, the swivel lobe 12 and the base lobe 20 can be identically shaped or shaped differently from each other.

Figure 6:
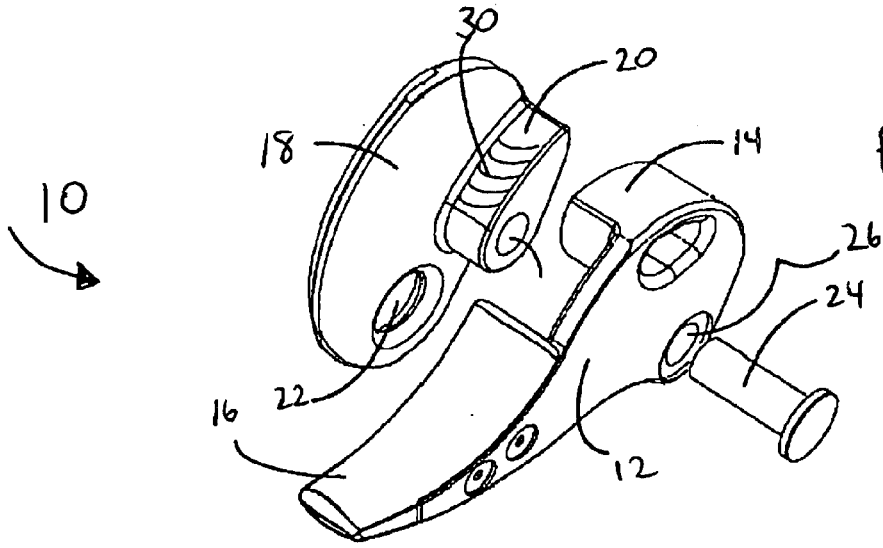
FIG. 6 is an exploded view illustrating another embodiment of the belay device for climbers, constructed in accordance with the present invention.

As illustrated in FIG. 6, a plurality of teeth 30 can be added to the base lobe 20 of the base plate 18 and/or the swivel lobe 14 of the swivel plate 12. The teeth 30 are preferably disposed along the surface of the lobe 14 or 20 that helps define the channel 28 through which the rope 29 moves through the belay device 10. Consequently, the teeth 30 enhance the grip the belay device 10 exerts on the rope 29, particularly if the channel 28 is narrowed and the rope 29 slowed or stopped due to the climber's fall or other emergency.

Figure 7:
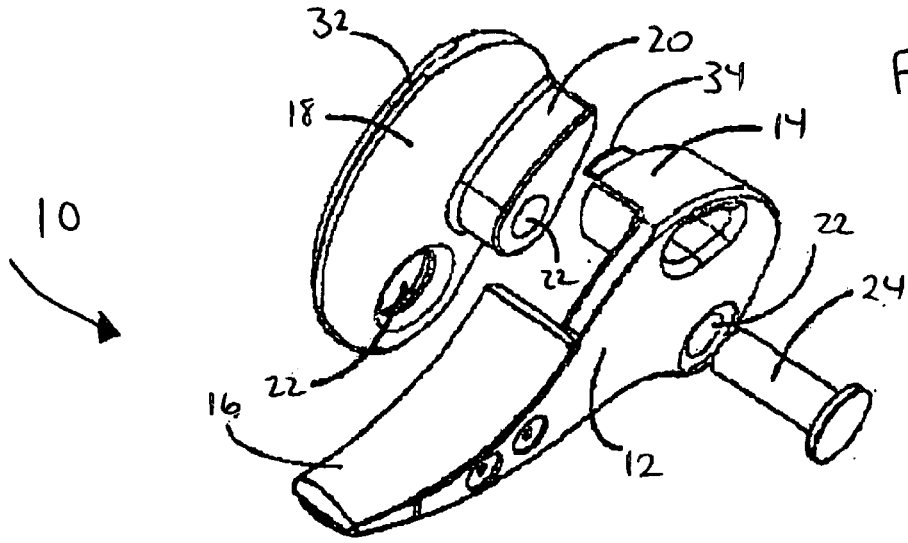
FIG. 7 is an exploded view illustrating still another embodiment of the belay device for climbers, constructed in accordance with the present invention.

As illustrated in FIG. 7, the base plate 18 can have a slot 32 around its peripheral edge. A tab 34 on the swivel plate 12 rides along this slot 32 when the swivel plate 12 and the base plate 18 move relative to each other providing additional stability to the belay device 10.

Figure 8A:
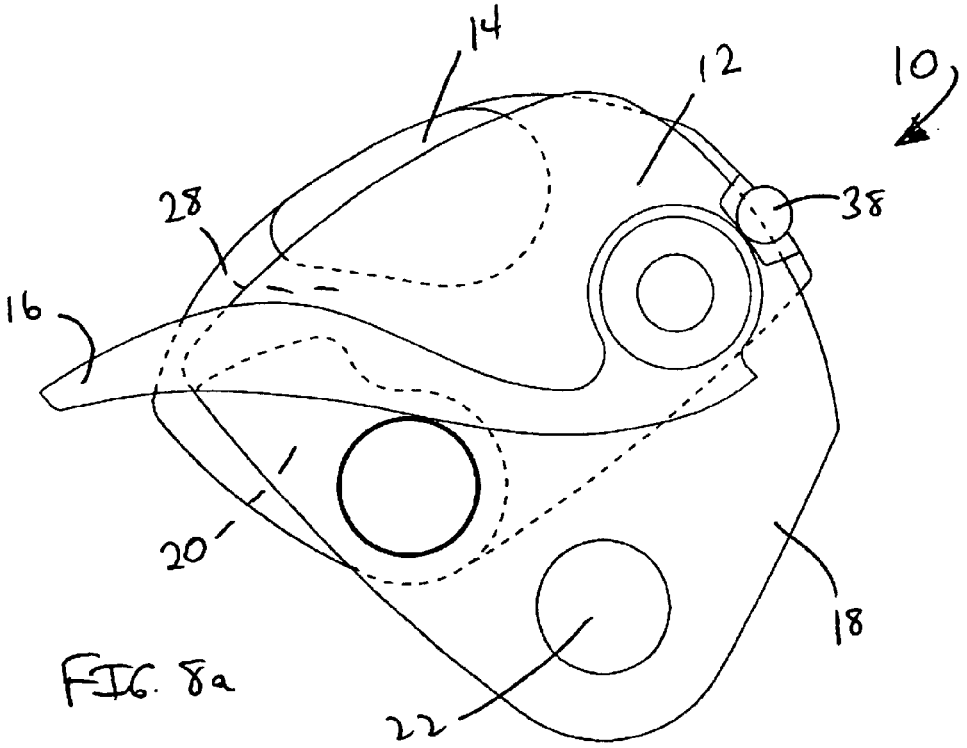
FIG. 8*a* is a side view illustrating yet another embodiment of the belay device for climbers, constructed in accordance with the present invention, with a handle in the rope-impeded second position.
Figure 8B:
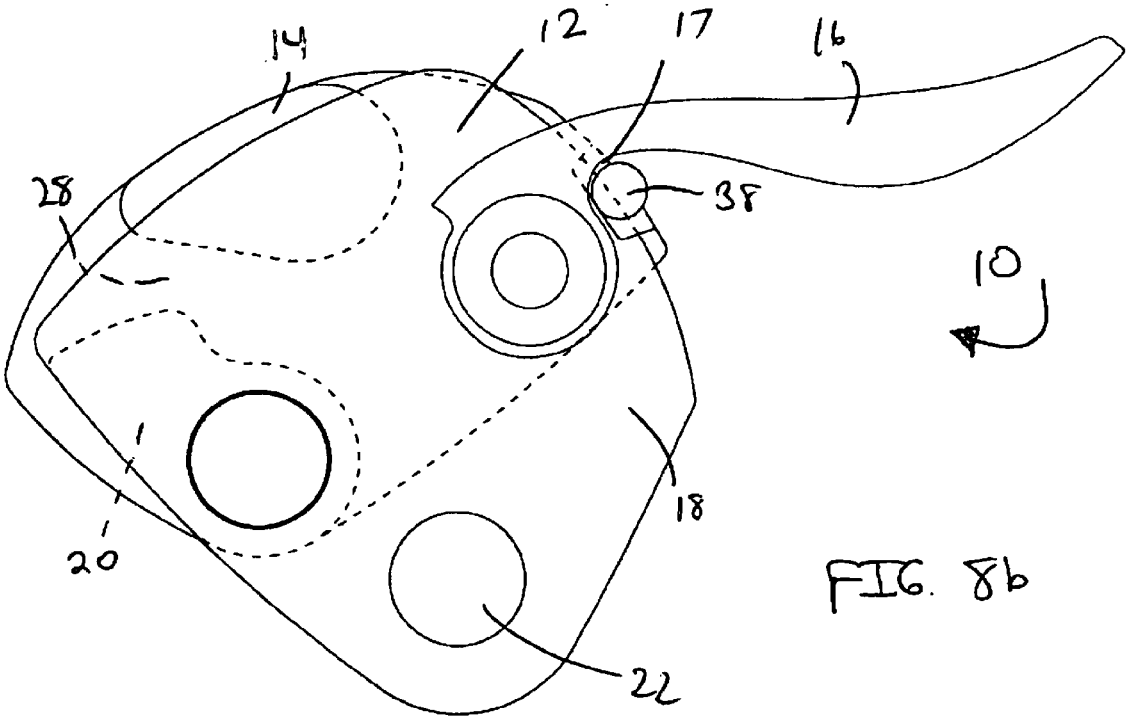
FIG. 8*b* is a side view illustrating the belay device for climbers of FIG. 8*a*, constructed in accordance with the present invention, with the handle being moved into the released first position.
Figure 9:
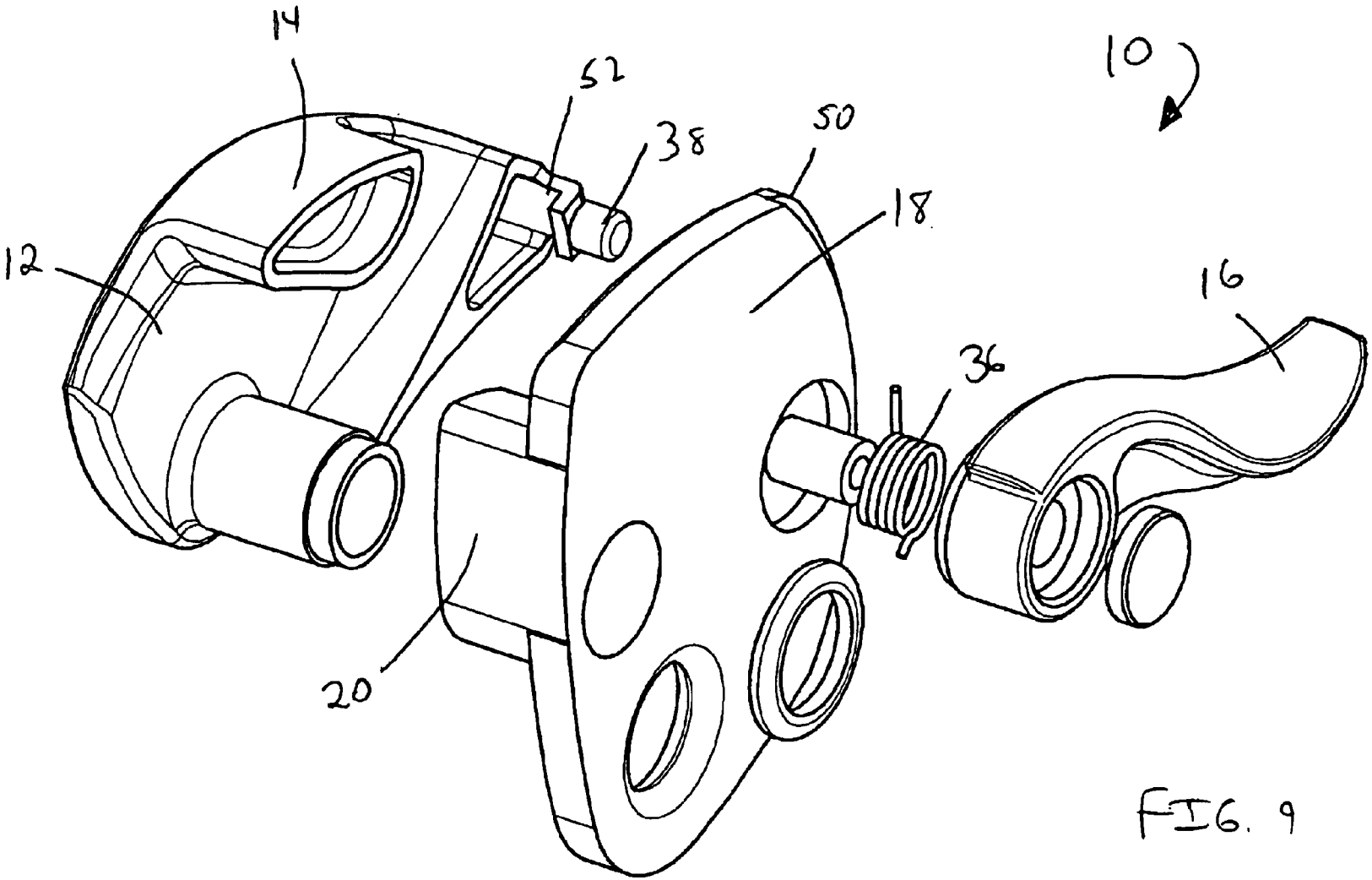
FIG. 9 is an exploded view illustrating the belay device for climbers of FIG. 8, constructed in accordance with the present invention.
Figure 10:
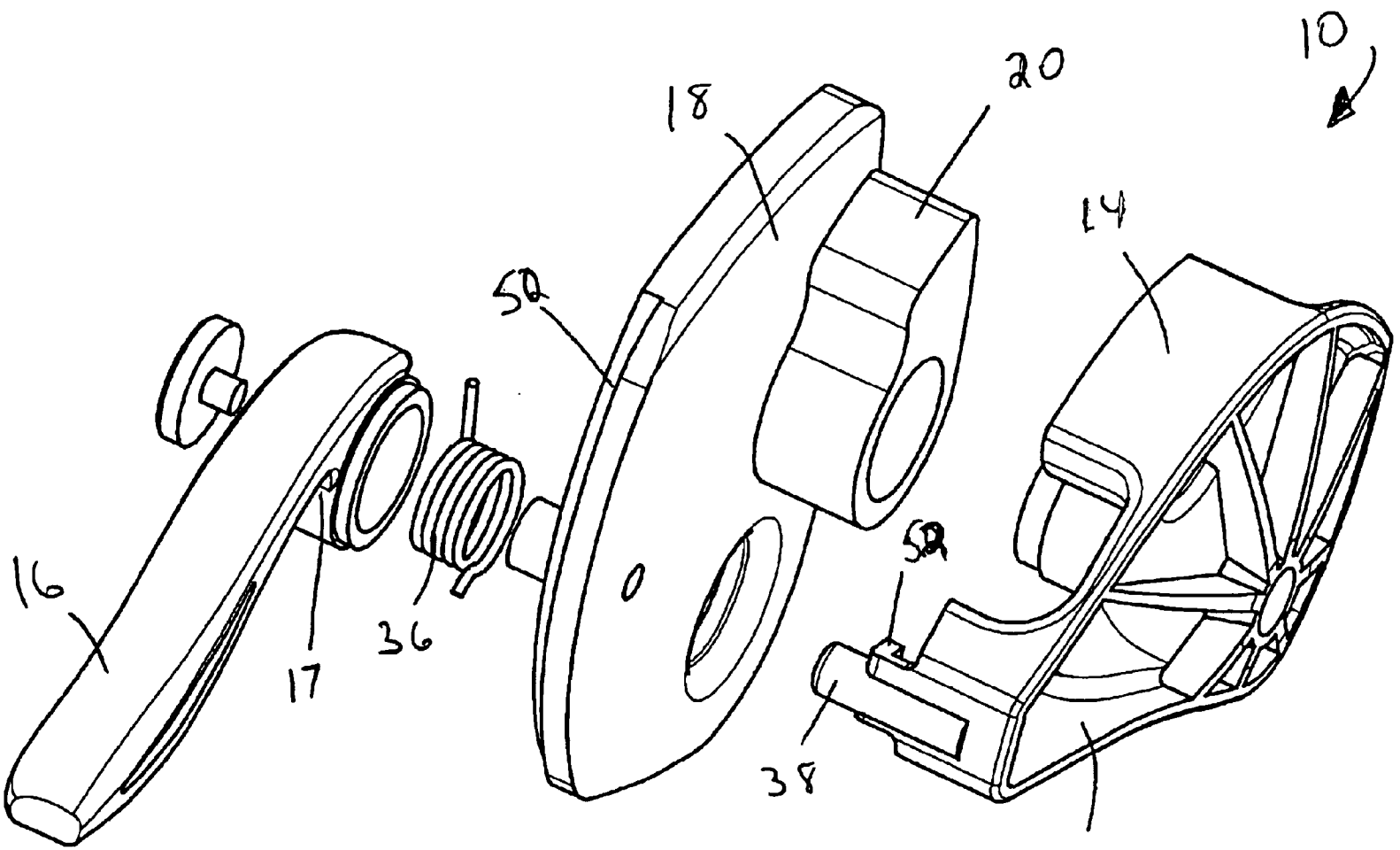
FIG. 10 is another exploded view illustrating the belay device for climbers of FIG. 8, constructed in accordance with the present invention.

Referring now to FIGS. 8–10, in another embodiment of the belay device 10 of the present invention, the handle 16 is rotatably secured to the base plate 18 rather than the swivel plate 12. The handle 16 is rotatable and includes a spring mechanism 36 for biasing the handle 16 into the impeded second position. When the handle 16 is in the impeded second position, the swivel plate 12 and the base plate 18 are positioned such that the channel 28 is narrowed about the rope 29 to impede the travel of the rope 29 through the channel 28. When the handle 16 is moved toward a second position, the swivel plate 12 and the base plate 18 are moved such that the channel 28 is widened allowing the rope 29 to freely travel through the channel 28. If the climber attached to the rope 29 fell, the handle 16 will return to the impeded second position with the swivel plate 12 being pulled upward by the rope 29 narrowing the channel 28 and either slowing or stopping movement of the rope 29 through the belay device 10.

The swivel plate 12 of the belay device 10 of the present invention includes a handle pin 38. A downward force on the handle 16 engages the handle pin 38 in a slot 17 on the handle 16 resulting in the base plate 18 moving in opposite rotation of the swivel plate 12 causing the base lobe 20 and the swivel lobe 14 to further separate and widen the channel 28. The handle pin 38 can be formed on the swivel plate during manufacture of the belay device or be a separate piece added after manufacture is completed.

In addition, the base plate 18 includes a shelf 50 for following a guide 52 on the swivel plate 12. The guide 52 maintains the base plate 18 relative to the swivel plate 12 during rotation of the swivel plate 12 relative to the base plate 18.

Figure 11:
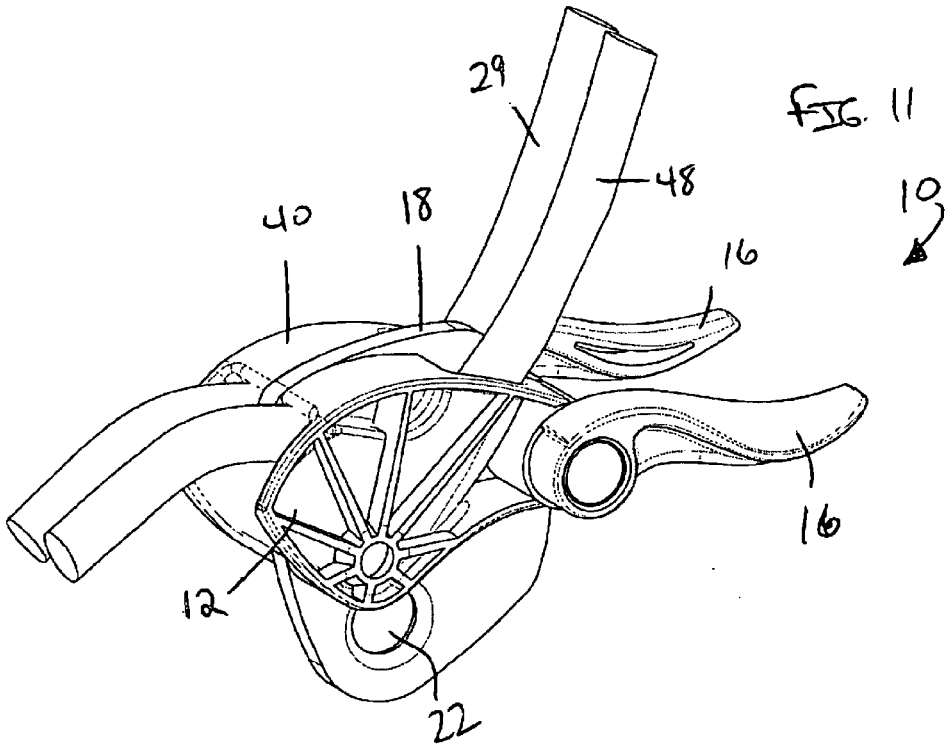
FIG. 11 is a perspective view illustrating still yet another embodiment of the belay device for climbers, constructed in accordance with the present invention, with the belay device usable with two ropes.
Figure 12:
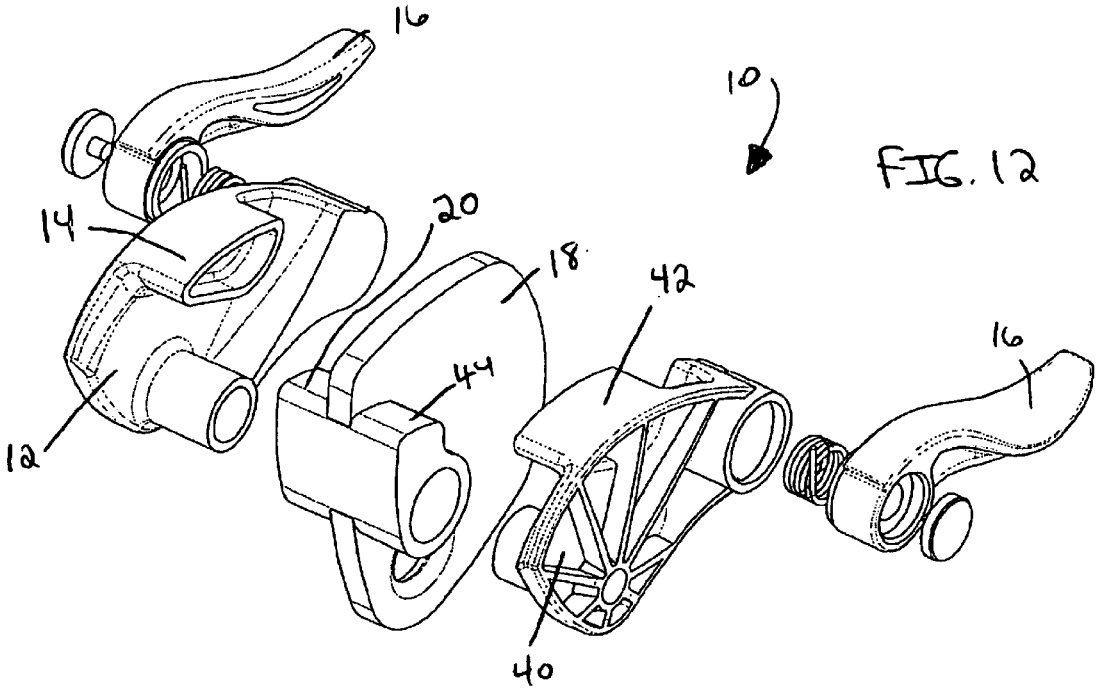
FIG. 12 is an exploded view illustrating the belay device for climbers of FIG. 11, constructed in accordance with the present invention.

Referring now to FIGS. 11 and 12, the belay device 10 of the present invention includes a second swivel plate 40 rotatably mounted to the opposite side of the base plate 18. The second swivel plate 40 includes a second swivel lobe 42 and the base plate 18 includes a secondary base lobe 44 thereby forming a second channel for receiving a second rope 48. Operation of the belay device 10 of this embodiment of the present invention is similar to the operation described above.

In all embodiments, preferably, the swivel plate 12, the swivel lobe 14, the base plate 18, and the base lobe 20 are formed from metal although forming the swivel plate 12, the swivel lobe 14, the base plate 18, and the base lobe 20 from other materials including, but not limited to, plastic, fiberglass, ceramics, resin, etc., are within the scope of the present invention.

In sum, the present invention is a belay device 10 for climbing. The belay device includes a first plate 12 having a first lobe 14; a second plate 18 having a second lobe 20; a connecting pin 24 connecting the first plate 12 and the second plate 18 together and allowing the first plate 12 and the second plate 18 to rotate relative to each other; and a channel defined by the first plate 12, the second plate 18, the first lobe 14, and the second lobe 20 through which a rope 29 moves through the belay device 10. Tension on the rope 29 rotates the first plate 12 to narrow the channel 28 by moving the first lobe 14 and the second lobe 20 toward each other thereby impeding or inhibiting movement of the rope 29 through the belay device 10.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A belay device for climbing with at least one rope, the belay device comprising:

a first plate having a first lobe, the rope adapted to wrap at least partially about the first lobe;

a second plate having a second lobe;

connection means for connecting the first plate to the second plate through a rotation point, the rotation point positioned inside the second lobe; and a first channel defined by a space between the first plate and the first lobe and the second plate and the second lobe, the rope adapted to be moveable through the first channel;

wherein tension on the rope rotates the first plate and the second plate relative to each other thereby narrowing the first channel and impeding movement of the rope through the first channel.

2. The belay device of claim 1 wherein the first lobe is integrally formed with the first plate and the second lobe is integrally formed with the second plate.

3. The belay device of claim 1 and further comprising:

a hole formed in the second plate for receiving a carabiner.

4. The belay device of claim 1 wherein the connection means is a connecting pin.

5. The belay device of claim 1 wherein the connection means is a shaft integrally formed in the first plate and extending into and secured within a hole in the second lobe and the second plate.

6. The belay device of claim 1 and further comprising:

a fixed handle on the first plate for rotating the first plate relative to the second plate.

7. The belay device of claim 1 and further comprising:

a rotatable handle on the second plate for rotating the second plate relative to the first plate.

8. The belay device of claim 7 and further comprising:

biasing means for biasing the rotatable handle into a first position.

9. The belay device of claim 8 wherein the first plate has a handle pin and the handle has a slot such that upon movement of the handle from the first position, the handle engages the handle pin in the slot resulting in the second plate moving in opposite rotation of the first plate causing the second lobe and the first lobe to further separate and widen the first channel.

10. The belay device of claim 1 and further comprising:

a slot formed about a peripheral edge of the second plate;

a tab formed on the first plate, the tab receivable within and following the slot upon movement of the first plate relative to the second plate.

11. The belay device of claim 1 wherein the second plate has a fourth lobe, and further comprising:

a third plate having a third lobe;

connection means for connecting the third plate to the second plate through the rotation point; and a second channel defined by the second plate and the fourth lobe and the third plate and the third lobe, a second rope adapted to be moveable through the second channel;

wherein tension on the second rope rotates the second plate and the third plate relative to each other thereby narrowing the second channel and impeding movement of the second rope through the second channel.

12. A system for controlling the ascent and descent of a climber, the system comprising:

at least one rope;

at least one carabiner;

a first plate;

a second plate having an aperture for receiving the carabiner, the second plate being rotatably secured to the first plate about a rotation point; and inhibiting means on the first plate and the second plate for defining a channel;

wherein upon tension of the rope, the aperture and the rotation point are offset narrowing the channel and impeding the movement of the rope.

13. The system of claim 12 wherein the inhibiting means is a first lobe formed on the first plate and a second lobe formed on the second plate.

14. The system of claim 12 and further comprising:

a fixed handle on the first plate for rotating the first plate relative to the second plate.

15. The system of claim 12 and further comprising:

a rotatable handle on the second plate for rotating the second plate relative to the first plate.

16. The system of claim 15 and further comprising:

biasing means for biasing the rotatable handle into a first position.

17. A method for inhibiting a climber from falling during climbing, the method comprising:

providing at least one rope;

providing at least one carabiner;

providing a belay device having a first plate rotatably secured to a second plate;

forming a first lobe on the first plate and a second lobe on the second plate;

inserting a portion of the rope into the belay device about at least a portion of the first lobe, the rope slidable about the first lobe;

attaching the carabiner to an aperture in the second plate;

applying a force to the rope in a direction generally away from the carabiner;

rotating the first plate relative to the second plate;

inhibiting movement of the rope through the belay device between the first lobe and the second lobe; and rotating the first plate relative to the second plate in an opposite direction to separate the first lobe and the second lobe thereby allowing the rope to slide through the belay device.

18. The method of claim 17 and further comprising;

securing a fixed handle on the first plate; and rotating the first plate relative to the second plate with the handle to separate the first lobe and the second lobe.

19. The method of claim 17 and further comprising:

securing a rotatable handle on the second plate; and forming a slot on the handle;

forming a pin on the first plate;

rotating the second plate relative to the first late until the handle engages the handle pin in the slot separating the first lobe an the second lobe.

20. The method of claim 17 and further comprising:

providing a third plate on the belay device;

forming a third lobe on the third plate;

forming a fourth lobe on the second plate;

rotatably connecting the third plate to the second plate; and inserting a portion of a second rope into the belay device about at least a portion of the third lobe, the second rope slidable about the third lobe;

applying a force to a second rope in a direction generally away from the carabiner;

rotating the second plate relative to the third plate;

inhibiting movement of a second rope through the belay device between the fourth lobe and the third lobe;

rotating the second plate relative to the third plate in an opposite direction to separate the fourth lobe and the third lobe thereby allowing the second rope to slide through the belay device.

* * * * *